US009045953B2

(12) United States Patent
Xu

(10) Patent No.: US 9,045,953 B2
(45) Date of Patent: Jun. 2, 2015

(54) SYSTEM AND METHOD FOR FRACTURING A FORMATION AND A METHOD OF INCREASING DEPTH OF FRACTURING OF A FORMATION

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 693 days.

(21) Appl. No.: 13/047,396

(22) Filed: Mar. 14, 2011

(65) Prior Publication Data

US 2012/0234546 A1 Sep. 20, 2012

(51) Int. Cl.

| | |
|---|---|
| ***E21B 33/128*** | (2006.01) |
| ***E21B 19/08*** | (2006.01) |
| ***E21B 7/15*** | (2006.01) |
| ***E21B 47/00*** | (2012.01) |

(52) U.S. Cl.
CPC . *E21B 19/08* (2013.01); *E21B 7/15* (2013.01); *E21B 47/00* (2013.01)

(58) Field of Classification Search
USPC ..... 166/282, 250.1, 308.1, 177.5, 318, 166/334.4
See application file for complete search history.

(56) References Cited

U.S. PATENT DOCUMENTS

| | | | | |
|---|---|---|---|---|
| 2,187,482 | A * | 1/1940 | Baker et al. | 166/121 |
| 2,916,092 | A * | 12/1959 | Burns | 166/124 |
| 2,927,638 | A * | 3/1960 | Hall, Sr. | 166/297 |
| 3,019,842 | A * | 2/1962 | Nutter | 166/126 |
| 3,090,436 | A * | 5/1963 | Briggs, Jr. | 166/63 |
| 3,136,361 | A * | 6/1964 | Marx | 166/308.1 |
| 4,569,396 | A * | 2/1986 | Brisco | 166/305.1 |
| 5,353,637 | A * | 10/1994 | Plumb et al. | 73/152.17 |
| 5,425,424 | A | 6/1995 | Reinhardt et al. | |
| 7,234,533 | B2 * | 6/2007 | Gambier | 166/387 |
| 2002/0162660 | A1 * | 11/2002 | Depiak et al. | 166/308 |
| 2007/0102165 | A1 | 5/2007 | Slup et al. | |
| 2009/0056934 | A1 | 3/2009 | Xu | |
| 2010/0044041 | A1 * | 2/2010 | Smith et al. | 166/280.1 |
| 2010/0175895 | A1 | 7/2010 | Metcalfe | |

OTHER PUBLICATIONS

Notification of the International Search Report and the Written Opinion of the International Searching Authority; PCT/US2012/025246; mailed Sep. 7, 2012; Korean Intellectual Property Office; 9 pages.

Ali Daneshy, SPE, "Horizontal-Well Fracturing: Why is it so Different?"; Technology Update, JPT, Sep. 2009, pp. 28-35.

* cited by examiner

*Primary Examiner* — Cathleen Hutchins
*Assistant Examiner* — Ronald Runyan
(74) *Attorney, Agent, or Firm* — Cantor Colburn LLP

(57) ABSTRACT

A system for fracturing a formation includes a tubular positionable within a formation borehole having at least one port therethrough configured to provide fluidic communication from inside the tubular to the formation borehole. The system also includes a seal sealably attachable to both the tubular and walls of the formation borehole, a seat in operable communication with the tubular and a member in operable communication with the seat such that movement of the seat relative to the tubular causes the member to engage the walls and provide stress thereto.

22 Claims, 4 Drawing Sheets

SYSTEM AND METHOD FOR FRACTURING A FORMATION AND A METHOD OF INCREASING DEPTH OF FRACTURING OF A FORMATION

BACKGROUND

Fracturing earth formations in downhole industries such as those concerned with hydrocarbon recovery and carbon dioxide sequestration, for example, can increase permeation of the formation. Increased permeation often facilitates more complete drainage of hydrocarbons during the life of a well or greater total capacity of carbon dioxide storage.

In horizontal or highly deviated boreholes, however, fractures of a formation have a tendency to orient parallel to an axis of the borehole and accordingly limit depth of penetration in directions away from the borehole. These issues limit the effectiveness of the fracturing operation. Systems and methods to improve the effectiveness of fracturing are well received in the art.

BRIEF DESCRIPTION

Disclosed herein is a system for fracturing a formation. The system includes a tubular positionable within a formation borehole having at least one port therethrough configured to provide fluidic communication from inside the tubular to the formation borehole. The system also includes a seal sealably attachable to both the tubular and walls of the formation borehole, a seat in operable communication with the tubular and a member in operable communication with the seat such that movement of the seat relative to the tubular causes the member to engage the walls and provide stress thereto.

Also disclosed is a method of fracturing a formation, including sealingly attaching a tubular to walls of a borehole in the formation, pressuring up the tubular, deforming a member in operable communication with the tubular into engagement with the walls, urging the member longitudinally away from the sealing attachment, stressing the walls with the urging, and pressuring up the formation.

Further disclosed is a method of increasing depth of fracturing a formation which includes applying longitudinal loads to walls of the formation and pressuring up against the formation.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
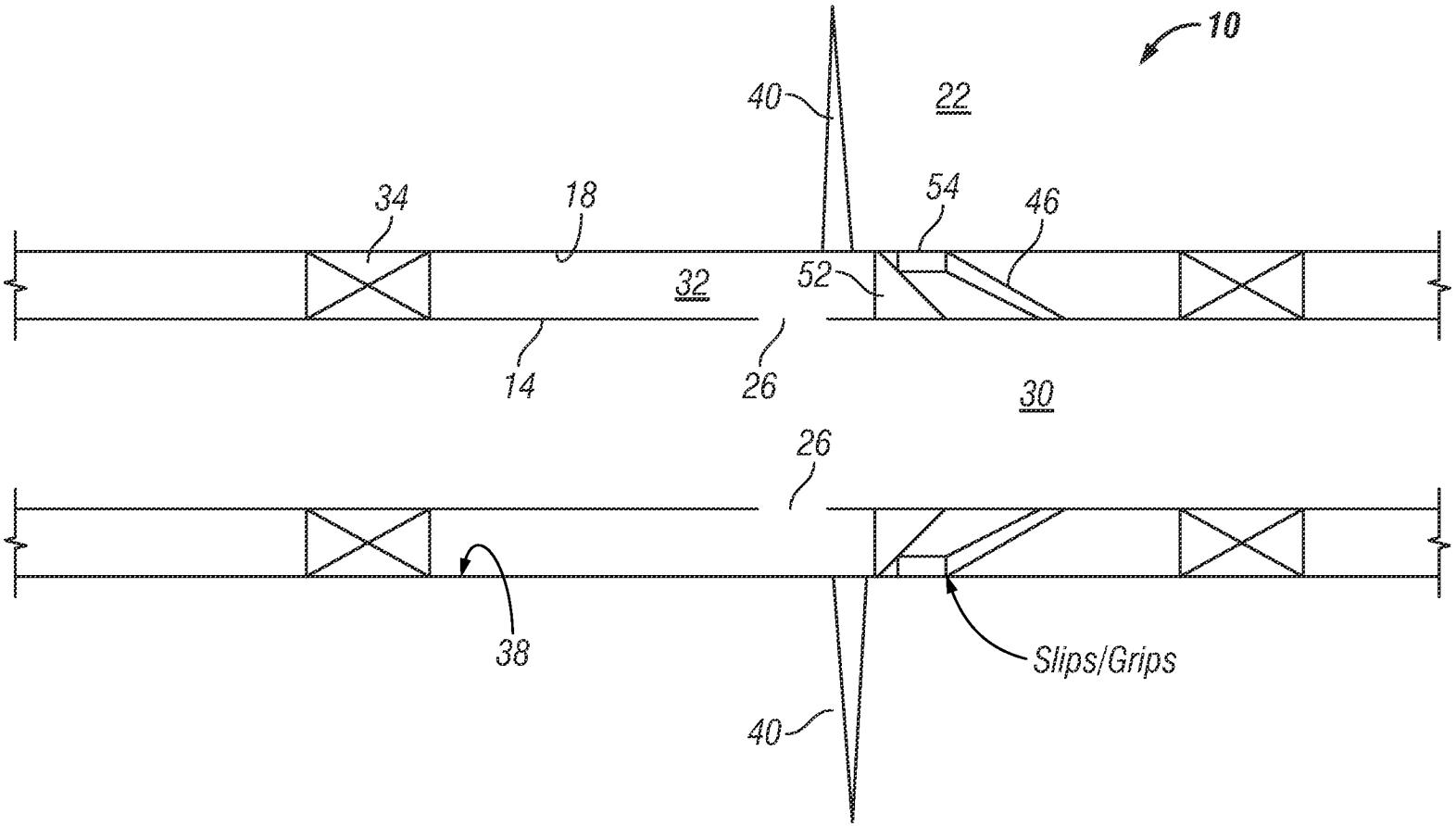
FIG. 1 depicts a schematic view of a fracturing system disclosed herein.

Referring to FIG. 1, an embodiment of a system for fracturing a formation is schematically illustrated at 10. The system 10 includes, a tubular 14 positionable within a borehole 18 in an earth formation 22, having at least one port 26, with a plurality being illustrated, configured to provide fluidic communication between an inside 30 of the tubular 14 and an annular space 32 defined between the tubular 14 and the formation 22. The system 10 also includes a seal 34 that can sealably anchor the tubular 14 with walls 38 of the borehole 18, via a packer, for example, as illustrated in the embodiment shown. A member 46 has a portion 54, illustrated herein as grips or slips that are engagable with the walls 38. The portion 54 is configured to provide longitudinally tensive forces to the walls 38 (i.e. between it and the seal 34) that encourage fractures 40 that initiate near the member 46 and protrude transversally deeper into the formation 22 as will be discussed in detail below.

Figure 2:
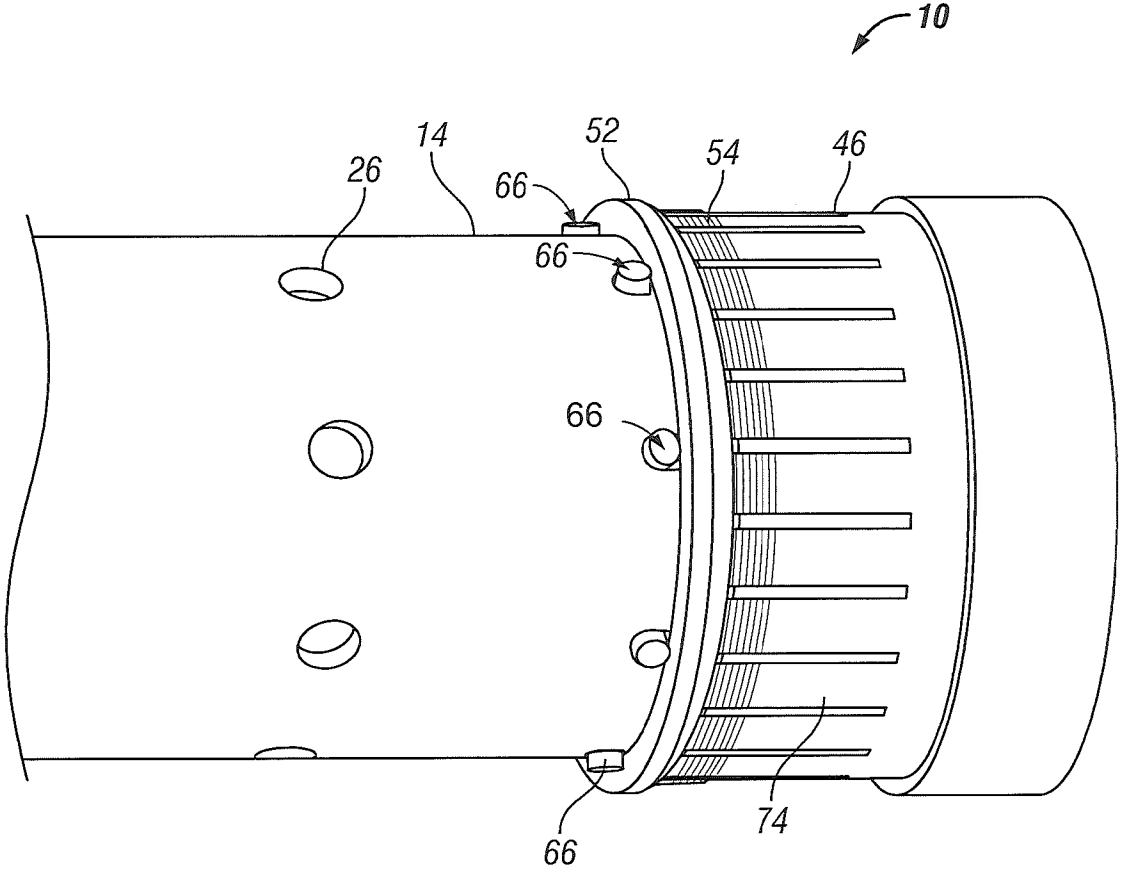
FIG. 2 depicts a partial perspective view of a portion of the fracturing system of FIG. 1.
Figure 3:
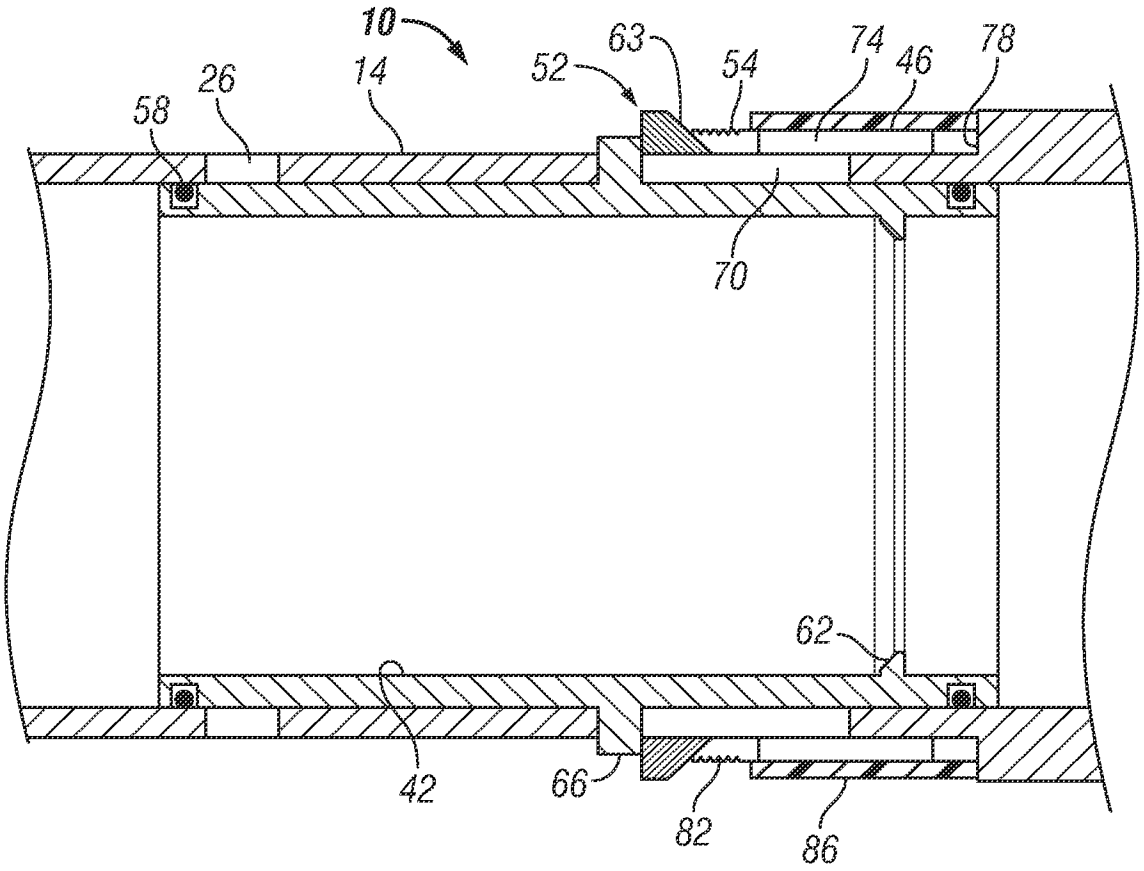
FIG. 3 depicts a partial cross sectional view of the fracturing system of FIG. 1 in a configuration prior to beginning fracturing.
Figure 4:
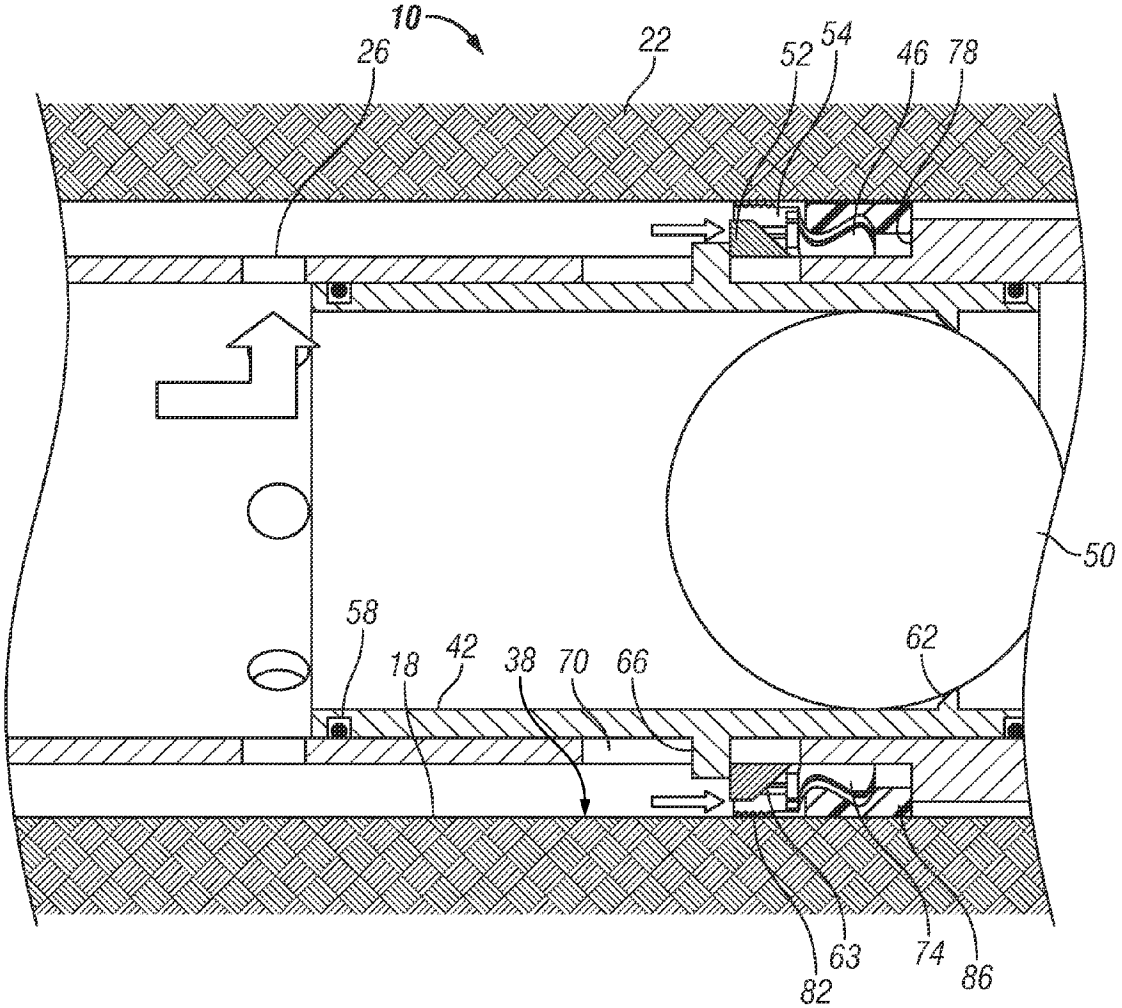
FIG. 4 depicts a partial cross sectional view of the fracturing system of FIG. 1 in a configuration ready for performing fracturing.

Referring to FIGS. 2-4, a seat 42 (FIGS. 3 and 4) is in operable communication with the member 46 and with the tubular 14. The seat 42 is pluggable with a plug 50, shown herein as a ball, that is runnable within the tubular 14. Movement of the seat 42 relative to the tubular 14 opens the ports 26 and deforms at least the portion 54 of the member 46 via engagement with a cone 52 and causes an increase in radial dimensions of the member 46 into engagement with the walls 38. Continued forces on the seat 42, after the portion 54 has engaged the walls 38 creates stress in the formation 22. A spreading force between the seal 34 and the portion 54 generates this stress in the formation 22. This spreading force initiates and induces fracturing of the formation 22 in directions transverse to an axis of the borehole 18. The stresses promote greater depth in the perpendicular directions that can increase permeation of the formation 22 and improve effectiveness of the fraccing operation. This increase in fraccing depth is especially helpful, in horizontal or highly deviated wellbores wherein formations are apt to fracture horizontally (i.e. in directions parallel to the borehole axis) instead of perpendicular to the borehole axis.

A seal 58, shown herein as an o-ring, slidably sealingly engages the seat 42 to the tubular 14. The seal 58 is initially positioned such that the ports 26 are downstream of the plug 50 seated against the seat 42 thereby preventing fluidic communication between the inside 30 on an upstream side of the plug 50 and the annular space 32. After movement of the seat 42 in a downstream direction, and at least some deformation of the member 46 has occurred, the seal 58 is sufficiently moved to allow fluidic communication between the inside 30 and the annular space 32 through the ports 26. This fluidic communication allows for fracturing to take place via pressure supplied from a remote location through the tubular 14 and the ports 26. By positioning the ports 26 near the portion 54, flow through the ports 26 is focused more directly toward the fracture 40. This can further increase depths of the fractures 40 and positioning of proppant into the fracture 40.

Forces sufficient to cause deformation of the member 46 are generated by pressure against the plug 50 sealed against a frustoconical surface 62 of the seat 42. Protrusions 66 of the seat 42 extend radially through slots 70 in the tubular 14 and radially overlap the cone 52. As the seat 42 is moved (rightward in the Figures) the protrusions 66 move within the slots 70 loading frustoconical surfaces 63 of the cone 52 against the portions 54 of the member 46. The portions 54 are located on fingers 74 that are configured to deform under compressive loads of the member 46 between the cone 52 and a shoulder 78 of the tubular 14. The foregoing structure allows the portions 54 to move radially outwardly into engagement with the walls 38 of the borehole 18. Teeth 82 on the portions 54 bite into the walls 38 to discourage relative motion therebetween after engagement has been established. After such engagement continued forces on the seat 42 urging it further in the direction it has already traveled result in buckling of the fingers 74 thereby building stress in the formation 22 as the portions 54 are urged longitudinally away from the seal 34.

Embodiments disclosed herein optionally include sealingly engaging the tubular 14 to the walls 38 with a deformable element 86 positioned proximate the member 46. The element 86 can be configured to be structurally supported by and sealingly engaged to the shoulder 78 while being radially deformable in response to the buckling of the fingers 74. Sealing of the element 86 to the walls 38 would allow pressure in the annular space 32, supplied through the ports 26, to build between the seal of the element 86 and seal of the seal 34, thereby concentrating pressure to portions of the formation 22 located therebetween.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A system for fracturing a formation, comprising:

a tubular positionable within a formation borehole having at least one port therethrough configured to provide fluidic communication from inside the tubular to the formation borehole;

a seal sealably attachable to both the tubular and walls of the formation borehole and being anchorable to the walls;

a seat sealingly engagable with the tubular and positioned along the tubular on a side of the at least one port opposite from the seal; and a member in operable communication with the seat and the tubular such that movement of the seat relative to the tubular in a direction away from the seal causes the member to engage and grip the walls and provide stress to the walls having a longitudinally tensive component.

2. The system for fracturing a formation of claim 1, wherein the seat is sealingly receptive to a plug.

3. The system for fracturing a formation of claim 1, wherein the at least one port is initially located downstream of a plug seated against the seat.

4. The system for fracturing a formation of claim 1, further comprising an element in operable communication with the member configured to sealingly engage with walls of the formation borehole in response to deformation of the member.

5. The system for fracturing a formation of claim 1, wherein the stress is applied between the seal and the member.

6. The system for fracturing a formation of claim 1, wherein the stress applied to the formation from the system is in response to urging of the member engaged with the walls longitudinally away from the seal attached to the walls.

7. The system for fracturing a formation of claim 1, wherein the at least one port is located near where the member engages the walls.

8. A system for fracturing a formation comprising:

a tubular positionable within a formation borehole having at least one port therethrough configured to provide fluidic communication from inside the tubular to the formation borehole;

a seal sealably attachable to both the tubular and walls of the formation borehole and being anchorable to the walls;

a seat in operable communication with the tubular and positioned along the tubular on a side of the at least one port opposite from the seal; and a member in operable communication with the seat such that movement of the seat relative to the tubular in a direction away from the seal causes the member to engage and grip the walls and provide stress to the walls having a longitudinally tensive component, the member being compressible between the seat and the tubular.

9. The system for fracturing a formation of claim 8, wherein at least a portion of the member deforms radially outwardly in response to movement of the seat.

10. The system for fracturing a formation of claim 9, further comprising a cone in operable communication with the seat and the member.

11. The system for fracturing a formation of claim 9, wherein fingers of the member are configured to buckle after the at least a portion of the member has engaged with walls of the formation borehole.

12. A method of fracturing a formation, comprising:

sealingly attaching a tubular to walls of a borehole in the formation;

seating a plug against a seat in operable communication with the tubular and a member;

pressuring up the tubular;

deforming the member into gripping engagement with the walls;

moving the seat and the member longitudinally away from the sealing attachment;

tensively stressing the walls with the moving; and pressuring up the formation.

13. The method of fracturing a formation of claim 12, further comprising:

pressuring up against the seated plug;

sealingly moving the seat relative to the tubular; and compressing the member between the seat and the tubular.

14. The method of fracturing a formation of claim 12, further comprising deforming at least a portion of the member radially outwardly.

15. The method of fracturing a formation of claim 12, further comprising buckling fingers of the member.

16. The method of fracturing a formation of claim 12, further comprising porting pressure within the tubular to the walls.

17. The method of fracturing a formation of claim 16, wherein the porting is near the gripping engagement.

18. The method of fracturing a formation of claim 12, wherein the tensively stressing of the walls is greater near the gripping engagement than at locations further from the gripping engagement.

19. The method of fracturing a formation of claim 12, further comprising sealingly engaging the walls with an element in response to deformation of the member.

20. The method of fracturing a formation of claim 12, further comprising fracturing the formation.

21. A method of increasing depth of fracturing a formation, comprising:

engaging a seal to a tubular and to walls of the formation:

moving a seat in operable communication with the tubular;

moving a member in operable communication with the seat and the tubular and engaged with the walls of the formation away from the seal;

applying longitudinally tensive loads to walls of the formation; and pressuring up against the formation.

22. The method of increasing depth of fracturing a formation of claim 21, further comprising fracturing the formation.

* * * * *